US006612484B2

(12) United States Patent
Rawlings et al.

(10) Patent No.: US 6,612,484 B2
(45) Date of Patent: Sep. 2, 2003

(54) DUPLEX ENVELOPE

(75) Inventors: Timothy W. Rawlings, Waynesville, OH (US); Wendell B. Halbrook, Jr., Waynesville, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 10/158,319

(22) Filed: May 30, 2002

(65) Prior Publication Data

US 2002/0195484 A1 Dec. 26, 2002

Related U.S. Application Data

(63) Continuation of application No. 09/891,922, filed on Jun. 26, 2001, now abandoned.

(51) Int. Cl.[7] ..... B65D 27/06
(52) U.S. Cl. ..... 229/305
(58) Field of Search ..... 229/305, 304, 229/92.1, 92.7

(56) References Cited

U.S. PATENT DOCUMENTS

| | | | | | |
|---|---|---|---|---|---|
| 458,117 | A | * | 8/1891 | De Long | 229/305 |
| 1,446,073 | A | * | 2/1923 | Stemen | 229/305 |
| 3,143,279 | A | * | 8/1964 | Black | 229/304 |
| 3,833,167 | A | * | 9/1974 | Kapitan | 229/305 |
| 4,148,430 | A | * | 4/1979 | Drake | 229/301 |
| 4,706,877 | A | * | 11/1987 | Jenkins | 229/304 |
| 4,756,468 | A | * | 7/1988 | Jenkins | 229/304 |
| 5,366,145 | A | * | 11/1994 | Sauerwine | 229/304 |
| 5,370,304 | A | * | 12/1994 | Sauerwine et al. | 229/304 |
| 5,501,393 | A | | 3/1996 | Walz | |
| 5,580,640 | A | | 12/1996 | Kraft et al. | |
| 6,152,361 | A | * | 11/2000 | Abercrombie et al. | 229/305 |

OTHER PUBLICATIONS

Wallace.com, "Wallace News & Highlights—New Product Announcements," May 13, 1999, two pages.
U.S. patent Ser. No. 09/837,958, filed Apr. 19, 2001, "Mass Produced Business Mailer", NCR Docket No. 8797.

* cited by examiner

*Primary Examiner*—Jes F. Pascua
(74) *Attorney, Agent, or Firm*—Francis L. Conte

(57) ABSTRACT

A duplex envelope includes a face sheet divided into a top page, bottom page, inner flap, and outer flap. A complementary liner is divided into a pocket bonded to the bottom page to define an inner envelope, an inner tab removably bonded to the inner flap, and an outer tab removably bonded to the outer flap. The top page is foldable over the liner pocket for defining an outer envelope closed by the outer flap.

20 Claims, 4 Drawing Sheets

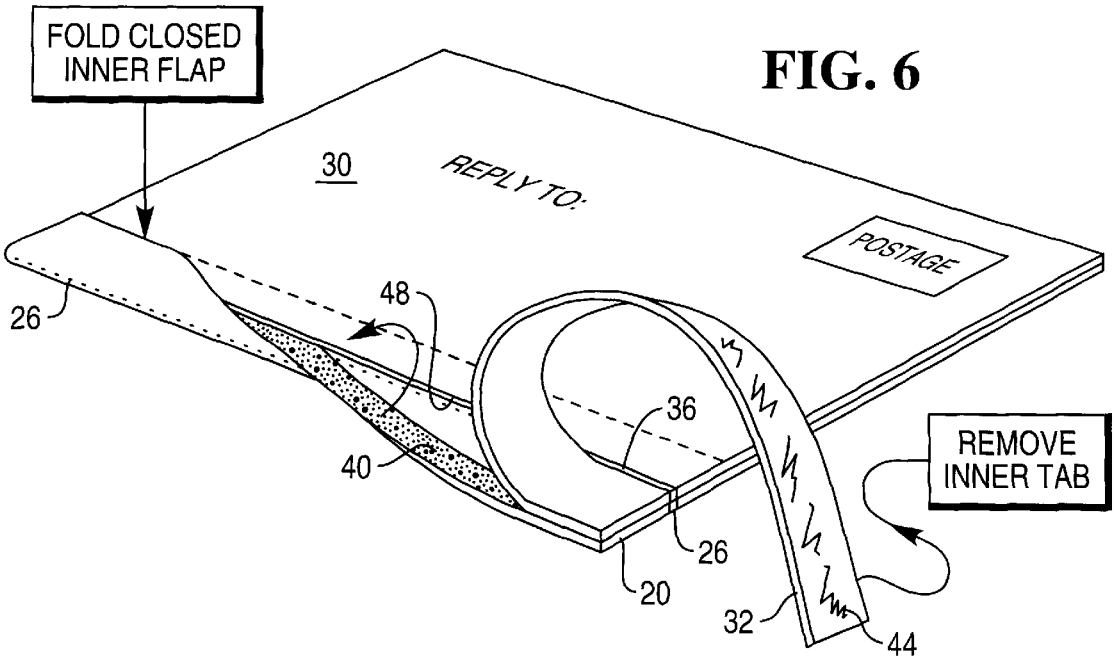
FIG. 6
FIG. 7
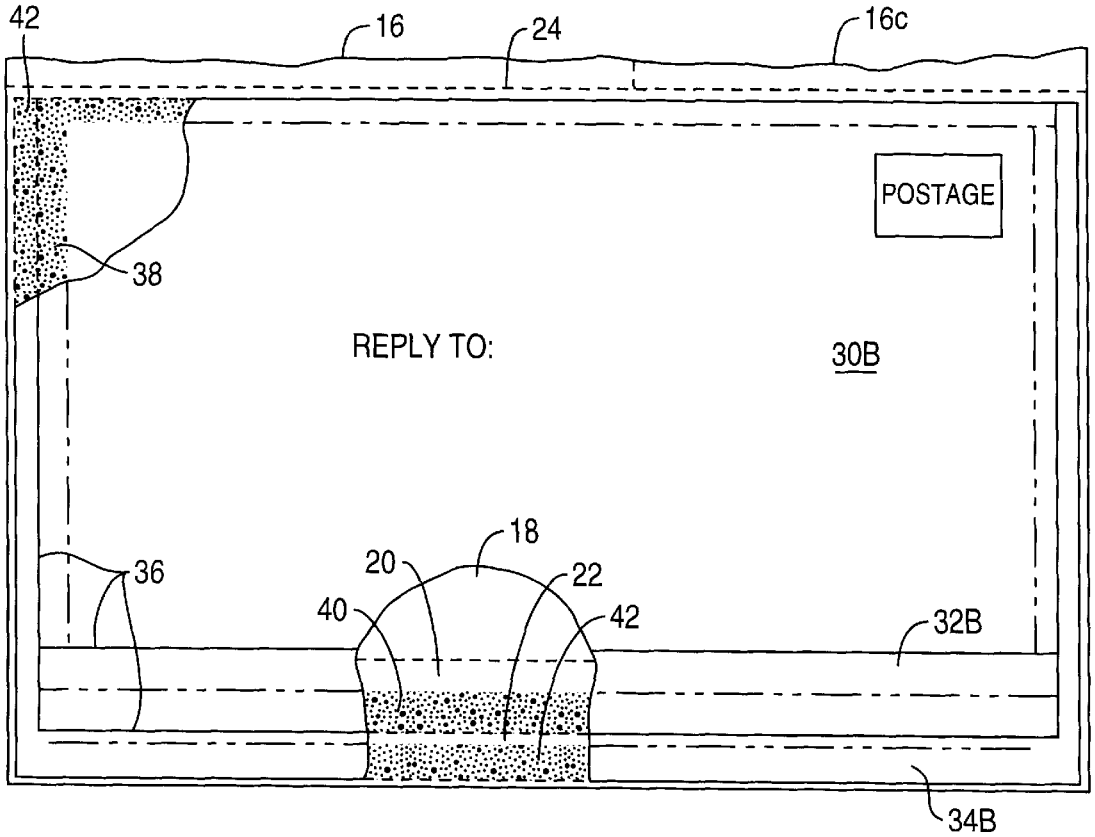

DUPLEX ENVELOPE

This application is a continuation of U.S. application Ser. No. 09/891,922 filed Jun. 26, 2001, abandoned.

BACKGROUND OF THE INVENTION

The present invention relates generally to stationery products, and, more specifically, to business mailers.

Many companies mail various items to consumers for reply therefrom. For example, billing statements are sent to consumers for payment of merchandise or services.

The typical billing statements is a sheet of paper printed on one or both sides with various information and is sent to the consumer in a suitably sized envelope. The consumer, in turn, returns a payment check to the sender in another envelope.

To improve the efficiency and convenience in paying bills, the sender typically provides a preaddressed return envelope with the original forwarding envelope. Return reply envelopes have various common forms. In one form, the reply envelope is simply a smaller envelope which fits inside the original forwarding envelope.

However, these multiple stationery items including the billing statement itself, the forwarding envelope, and the return envelope must be separately manufactured, separately printed, and then assembled for the original mailing to the consumers. This increases the complexity and cost of the billing process.

Accordingly, it is desired to provide an integrated forwarding and return envelope for reducing complexity and cost in business reply processes.

BRIEF SUMMARY OF THE INVENTION

A duplex envelope includes a face sheet divided into a top page, bottom page, inner flap, and outer flap. A complementary liner is divided into a pocket bonded to the bottom page to define an inner envelope, an inner tab removably bonded to the inner flap, and an outer tab removably bonded to the outer flap. The top page is foldable over the liner pocket for defining an outer envelope closed by the outer flap.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which:

FIG. 6 is an isometric view of the inner envelope illustrated in FIG. 5 being closed by an inner flap for re-mailing to another recipient.

FIG. 7 is the bottom portion of the duplex envelope illustrated in FIG. 1 in accordance with another embodiment of the present invention.

DETAILED DESCRIPTION OF THE INVENTION

Figure 1:
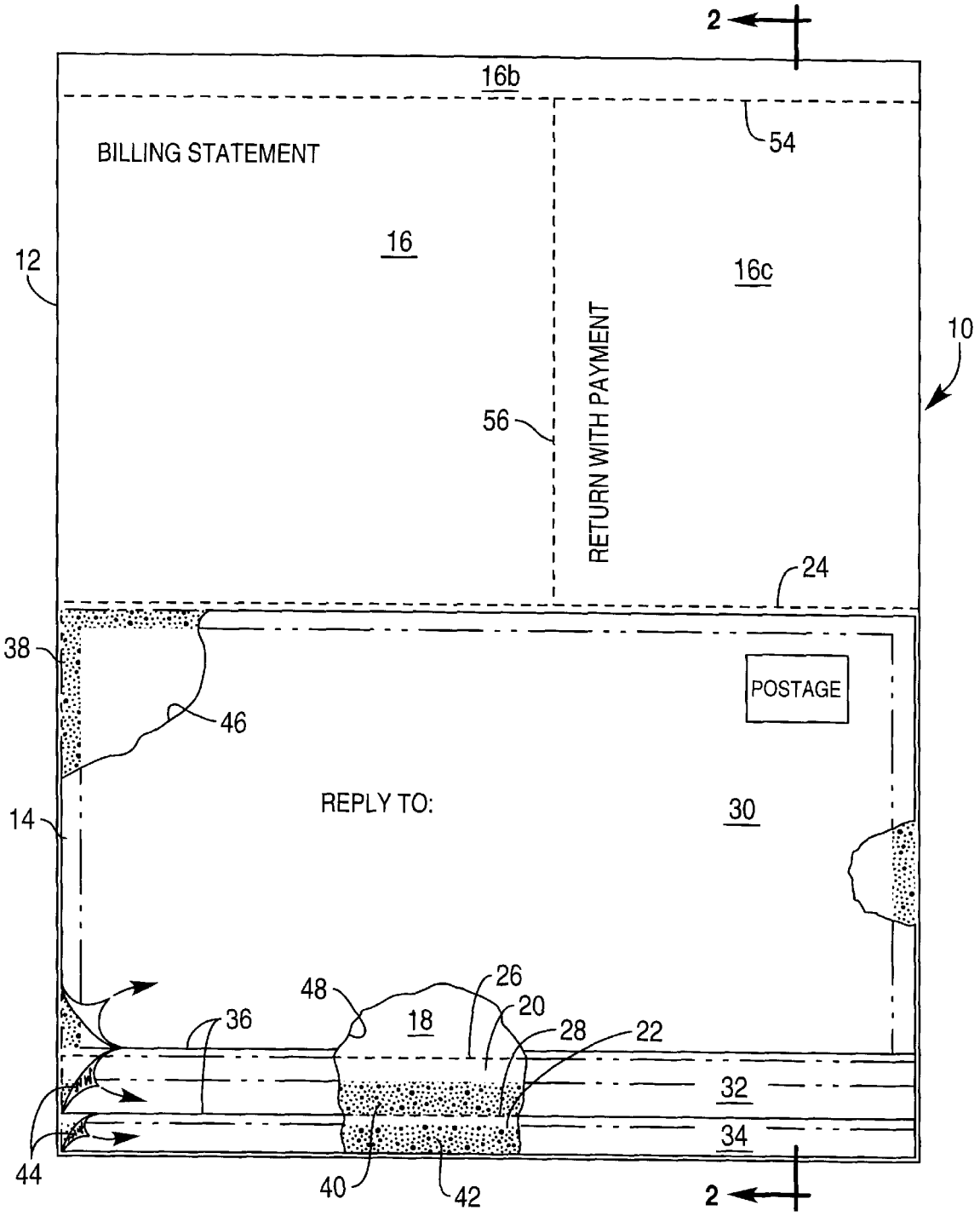
FIG. 1 is a plan view of a duplex envelope in accordance with an exemplary embodiment of the present invention.

Illustrated in FIG. 1 is a duplex envelope 10 in accordance with an exemplary embodiment. The envelope includes a first sheet 12 of any suitable material, such as face stock paper preferably in rectangular configuration. A liner 14 in the form of a second sheet of suitable material, such as paper, is suitably smaller than the face sheet for laminating the bottom rectangular portion thereof.

The face sheet 12 is initially flat and divided into a top page 16, a bottom page 18, an inner flap 20, and an outer flap 22 adjoining each other in turn by corresponding first, second, and third separation lines 24,26,28 preferably in the form of straight perforation lines extending across the full width of the face sheet.

Correspondingly, the liner 14 is divided into a pocket 30, an inner tab 32, and an outer tab 34 adjoining each other at corresponding diecuts 36.

An adhesive border 38 is disposed along three of the four edges of the rectangular bottom page 18. An adhesive inner strip 40 extends in a straight line over the full length of the narrow inner flap 20. And, an adhesive outer strip 42 similarly extends in a straight line along the full length of the narrow outer strip 42. The adhesive border and strips are preferably formed of suitable pressure sensitive adhesive of any conventional composition.

The liner inner and outer tabs 32,34 preferably include a silicone release coating 44 on the inner side thereof for being removably bonded to the corresponding inner and outer adhesive strips 40,42. The liner pocket 30 is preferably devoid of the release coating on its inner surface along the adhesive border 38 for forming a permanent bond with the underlying bottom page 18.

The liner 14 may be formed of any suitable material such as supercalendered kraft (SCK) paper which is thinner than the face sheet 12 and improves the effectiveness of the silicone release coating applied thereto. Alternatively, the liner may be formed of standard paper face stock like that of the face sheet 12, suitably treated with a release agent on the inner surfaces of the two tabs.

The liner 14 is smaller than the face sheet 12 and is laminated only to its bottom portion for providing a two-ply lamination therewith. The liner pocket 30 is permanently adhesively bonded to the bottom page 18 to define a pouch or inner envelope 46, shown best in cross section in FIG. 2. The inner tab 32 is removably bonded atop the inner flap 20 by the adhesive inner strip 40 and adjoins the pocket at the diecut therebetween. The outer tab 34 is removably bonded atop the outer flap 22 by the adhesive outer strip 42 and adjoins the inner tab at the diecut therebetween.

In this construction, the adhesive border 38 permanently bonds three edges of the perimeter of the pocket 30 to the bottom page except along the fourth edge of the perimeter which extends along the inner flap 32. This unbonded edge of the pocket 30 defines with the underlying bottom page 18 an inlet slot 48 through which flat items may be inserted into the inner envelope 46 as described in more detail hereinbelow.

Figure 2:
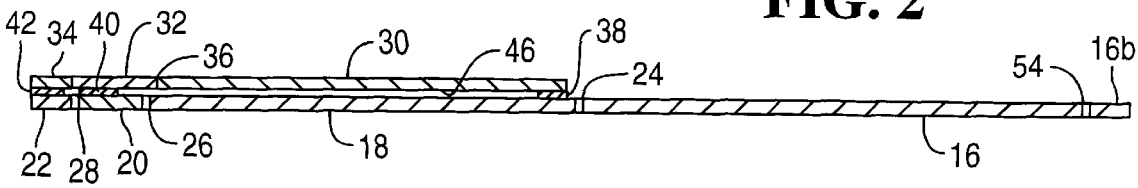
FIG. 2 is a longitudinal sectional view of the duplex envelope illustrated in FIG. 1 and taken along line 2—2.

The duplex envelope illustrated in FIGS. 1 and 2 provides a two-ply integrated assembly of components which may be conveniently used for sending desired information to a recipient and obtaining a reply therefrom, with envelopes therefor conveniently provided as part of the assembly. More specifically, FIG. 3 illustrates schematically that the duplex envelope illustrated flat in FIG. 1 may be conventionally printed on one or both sides using a suitable printer 50, such as a laser printer.

Figure 3:
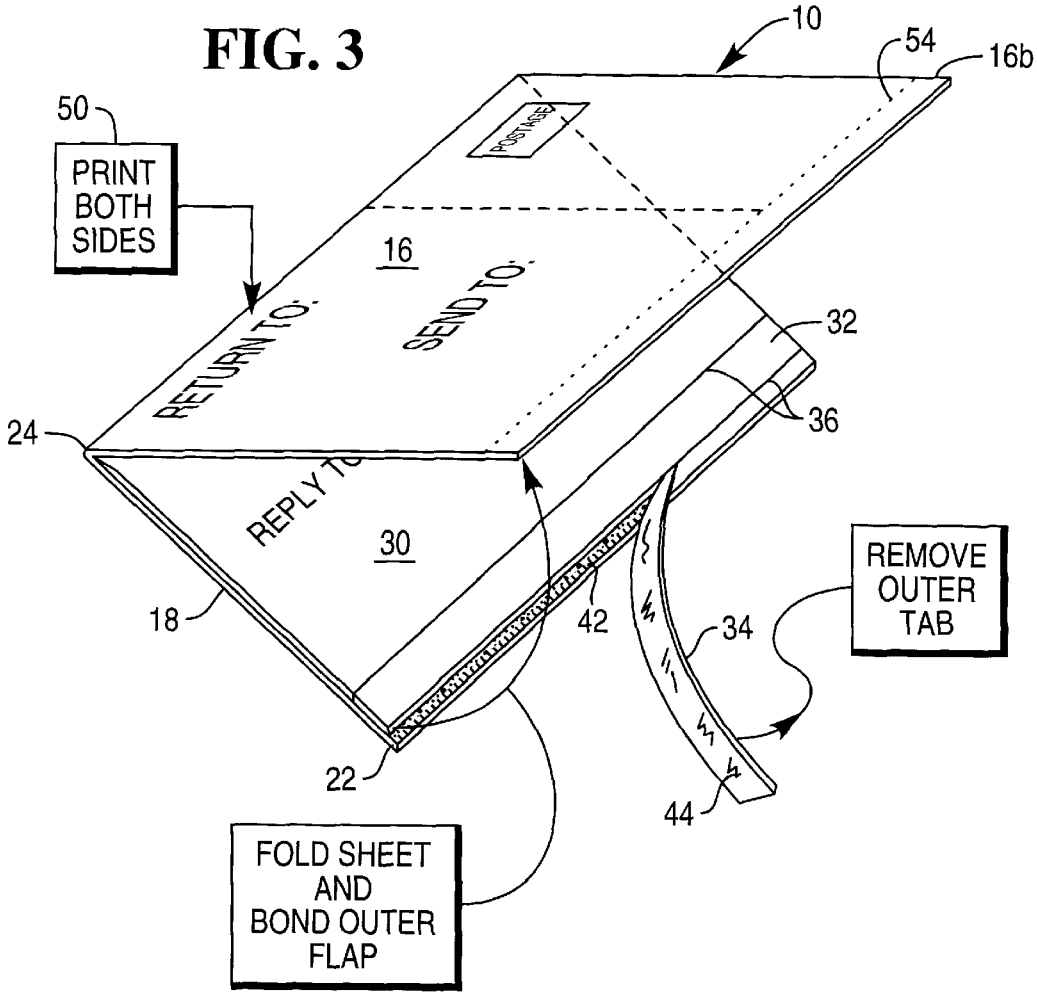
FIG. 3 is an isometric view of the duplex envelope illustrated in FIG. 1 being folded in use for forming an outer envelope.

As shown in FIGS. 1 and 3, any desired information may be printed on any of the exposed sides of the face sheet and liner including, for example, a billing statement or information on one side of the top page 16, with a mailing address being printed on the opposite side of the top page for sending to the intended recipient or customer. The outer tab 34 may be conveniently removed from the outer flap 22 by simply peeling the tab from the underlying adhesive outer strip 42.

The top page is then folded along the first perforation line 24 atop the bottom page into a three-ply folded lamination. The outer flap 22 is laminated or pressed atop the corresponding top edge of the top page to permanently bond the adhesive outer strip 42 thereto. In this folded enclosed configuration, the top page rests atop the liner pocket and defines an outer envelope which may be sent to a recipient in any conventional manner, such as by affixing postage to the top page and depositing the envelope with the postal service. When folded shut as illustrated in FIG. 4, the send-to and return-to addresses are printed on the back side of the top page, with the billing statement or other information printed on the front side of the top as illustrated in FIG. 1 which hides such information inside the closed envelope for enhanced security.

Figure 4:
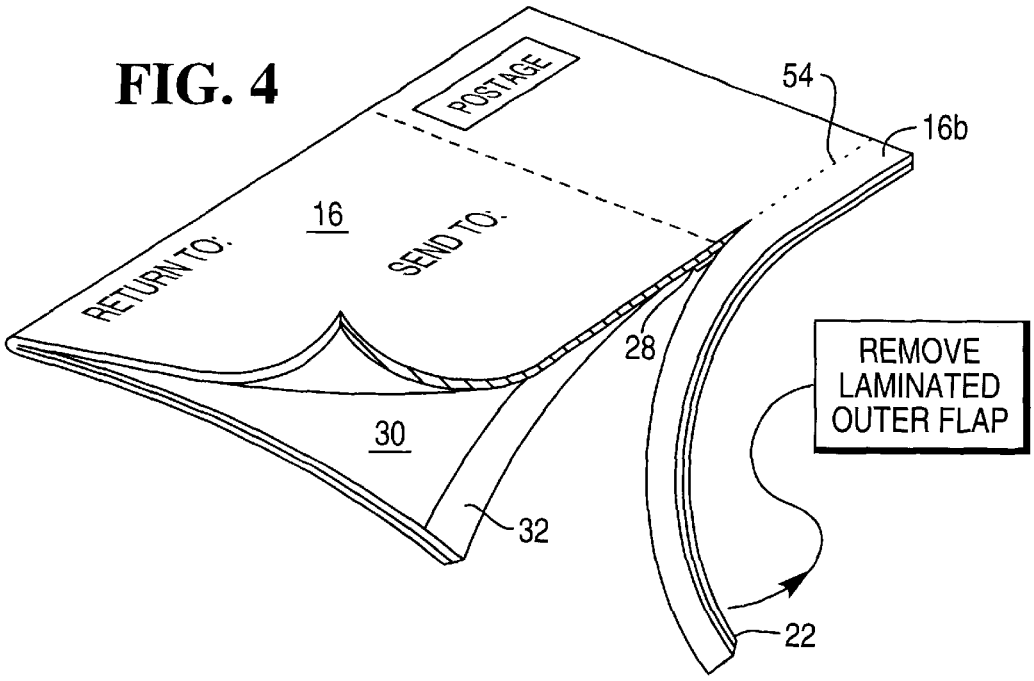
FIG. 4 is an isometric view of the completed outer envelope illustrated in FIG. 3 being opened by removal of the closed outer flap thereof.

Upon receipt by the intended recipient, the outer envelope may be opened by removing or tearing open the laminated outer flap 22 from the inner tab 32 and top page 16 as illustrated in FIG. 4. The third perforation line 28 provided between the inner and outer tabs permits precise tearing of the outer tab from the inner tab to open the envelope.

Figure 5:
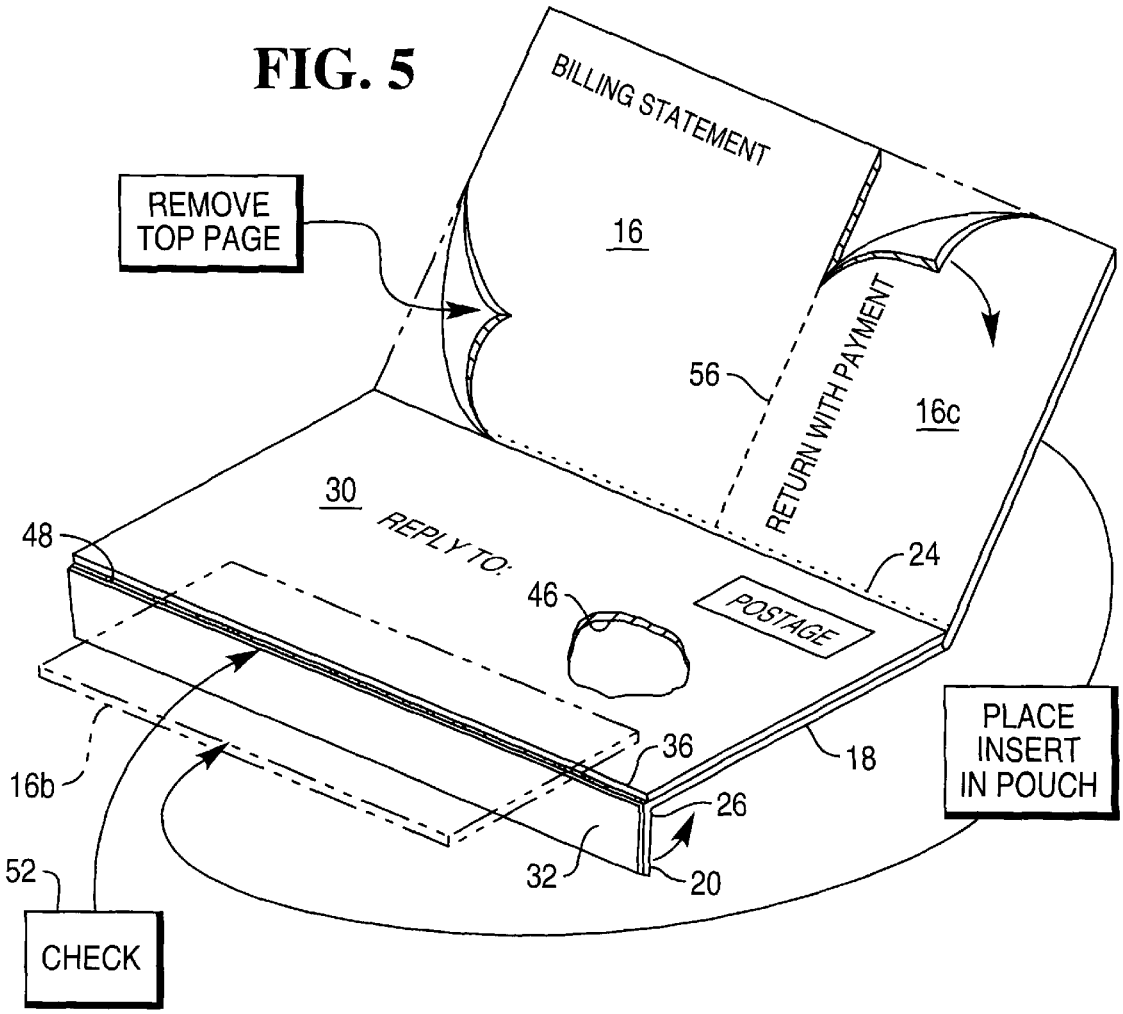
FIG. 5 is an isometric view of the outer envelope illustrated in FIG. 4 being disassembled for reuse of an inner envelope integrated therein.

As shown in FIG. 5, the outer envelope is opened by the recipient to expose the printed information contained on the top page 16 which, for example, may be a billing statement or invoice requiring payment by the recipient. The recipient may then remove the top page 16 from the bottom page 18 by tearing of the top page along the first perforation line 24. The recipient may then fold back the inner flap 20 at the separating diecut 36 with the pocket 30 for exposing the inlet slot 48 through which an insert, such as a payment check 52 may be inserted into the inner envelope defined by the pocket.

As shown in FIG. 6, the recipient then removes the inner tab 32 from the inner flap 20 by peeling it away from the adhesive inner strip 40. The inner flap 20 is again folded along the second perforation line 26 into laminated contact atop the adjoining edge of the pocket 30 to permanently bond the adhesive inner strip 40 thereto and close the inlet slot 48 of the inner envelope.

The exposed surface of the pocket 30 may be preprinted by the original sender with a return or reply address, or may be printed by the recipient with the reply-to address. Suitable postage may be affixed to the closed inner envelope for mailing the envelope back to the original sender, or any other recipient as desired.

In this way, the two-ply duplex envelope illustrated in FIG. 1 may be printed with all desired information on one or both sides thereof and conveniently folded to form the outer envelope which is mailed to the intended recipient. The recipient opens the outer envelope removes the top page therefrom and re-uses the inner envelope for re-mailing any desired insert to a subsequent address such as the original sender.

In the exemplary embodiment illustrated in FIG. 1, the liner pocket 30, inner tab 32, and outer tab 34 extend in parallel across substantially the full width of the bottom page 18 and have corresponding rectangular configurations.

Correspondingly, the inner and outer adhesive strips 40,42 extend in parallel across substantially the full length of the inner and outer flaps 20,22, respectively, in narrow rectangular bands of pressure sensitive adhesive. The adhesive border 38 preferably extends continuously along the two side edges and the top edge of the bottom page 18, leaving a remaining fourth or bottom edge of the bottom page along the inner flap 20 devoid of adhesive to provide the inlet slot 48 for access into the inner envelope 46.

The top page 16 illustrated in FIG. 1 may contain any suitable printed information thereon as useful for intended recipients, and may be conveniently divided into subsections. For example, the top page may include a perforated fourth separation line 54 extending across the full width thereof, with the third and four perforation lines 28,54 being located equidistantly from the center first perforation line 24.

The fourth perforation line 54 is preferably spaced from the top edge of the top page to define a narrow closure band 16*b* extending across the width thereof matching in configuration the outer flap 22 for being permanently bonded thereto when laminated to the outer adhesive strip 42. In this way, both the outer flap 22 and band 16*b* laminated thereto may be conveniently torn away from the closed outer envelope as illustrated in FIG. 4 by tearing along the coextensive perforation lines 28,54.

As shown in FIG. 5, the top page 16 may also include a perforated fifth separation line 56 extending vertically between the first and fourth separation lines 24,54, and spaced laterally from the right side edge of the top page to define a reply insert 16*c* sized to fit flat inside the inner envelope without folding of the insert. The entire top page 16 is conveniently torn away from the bottom page 18, and then the reply insert 16*c* may be conveniently torn away from the billing statement along the fifth perforation line 56. In this way a convenient reply insert may be returned to the sender along with the payment check.

When the top and bottom pages are folded together as illustrated in FIG. 3 to form the outer envelope, that envelope is securely closed at the two opposite ends defined by the folding line 24 and the adhesively bonded outer flap 22. The remaining two side edges of the closed envelope are not bonded closed which limits the amount of security provided to the inside of the closed envelope.

Accordingly, FIG. 7 illustrates an alternate embodiment of the duplex envelope illustrated in FIG. 1 having improved security. This embodiment is substantially identical to that shown in FIG. 1 except that the outer tab, designated 34B, and the outer adhesive strip 42 extend in parallel along the outer flap 22, and then continue along opposite ends of the inner flap 20, and along opposite edges of the bottom page 18 to the first perforation line 24. In this way, the outer tab 34B has a generally U-shape configuration and surrounds at opposite left and right ends the slightly shorter inner tab 32B and pocket 30B.

Upon removal of the U-shaped outer tab 34B, the underlying adhesive outer strip 42 is provided continuously along the opposite left and right edges of the bottom page and the bottom edge thereof. Upon folding together of the top and bottom pages, the adhesive outer strip will permanently bond to the corresponding three edges of the top page for fully enclosing the entire perimeter of the outer envelope by adhesive along three edges and the continuous first perforation line 24 along the fourth edge.

In this way, the outer envelope is fully sealed for maximum security of the printed information contained therein.

And, additional inserts may be placed inside the outer envelope for forwarding to the intended recipient. And, if desired, inserts may be originally provided inside the inner envelope in the original mailing to the intended recipient.

The duplex envelope described above enjoys many advantages in its integrated construction. All desired printing of the various components thereof may be provided in one or two passes through the printer. Little waste is provided in using the duplex envelope since the inner and outer tabs 32,34, the outer flap 22, and the closure band 16*b* are relatively small portions of the entire assembly which are discarded after use. The duplex envelope is conveniently used by both the original sender and the intended recipient, and may be preaddressed for further convenience.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A duplex envelope comprising:

a face sheet divided into a top page, a bottom page, an inner flap, and an outer flap by corresponding first, second, and third separation lines;

a liner divided into a pocket permanently bonded to said bottom page to define an inner envelope therewith, an inner tab removably bonded atop said inner flap adjoining said pocket, and an outer tab removably bonded atop said outer flap adjoining said inner tab; and said top page being foldable atop said liner pocket for defining an outer envelope therewith.

2. A duplex envelope according to claim 1 further comprising:

an adhesive border permanently bonding the perimeter of said pocket to said bottom page;

an adhesive inner strip disposed along said inner flap and removably bonded to said inner tab; and an adhesive outer strip disposed along said outer flap and removably bonded to said outer tab.

3. A method of using said duplex envelope according to claim 2 comprising:

printing a mailing address on a back side of said top page;

removing said outer tab from said outer flap;

folding said top page atop said bottom page; and laminating said outer flap atop said top page to permanently bond said outer strip thereto.

4. A method according to claim 3 further comprising:

removing said laminated outer flap from said inner tab and top page;

removing said top page from said bottom page;

placing an insert inside said inner envelope;

removing said inner tab from said inner flap; and folding said inner flap atop said pocket to permanently bond said inner strip thereto and close said inner envelope.

5. A duplex envelope according to claim 2 wherein said first, second, and third lines comprise perforation lines.

6. A duplex envelope according to claim 5 wherein said liner pocket, inner tab, and outer tab are separated by corresponding diecuts.

7. A duplex envelope according to claim 6 wherein:

said liner inner and outer tabs include a silicone release coating for being removably bonded to said inner and outer adhesive strips; and said liner pocket is devoid of said release coating along said adhesive border for forming a permanent bond with said bottom page.

8. A duplex envelope according to claim 7 wherein said liner pocket, inner tab, and outer tab extend in parallel across the width of said bottom page.

9. A duplex envelope according to claim 8 wherein:

said inner and outer adhesive strips extend in parallel across the length of said inner and outer flaps, respectively; and said adhesive border extends continuously along three edges of said bottom page, leaving a remaining fourth edge of said bottom page along said inner flap devoid of adhesive to provide an inlet slot for said inner envelope.

10. A duplex envelope according to claim 7 wherein said outer tab and outer adhesive strip extend along said outer flap and continue along opposite ends of said inner flap and along opposite edges of said bottom page to said first separation line.

11. A duplex envelope according to claim 10 wherein said adhesive border extends continuously along three edges of said bottom page, leaving a remaining fourth edge of said bottom page along said inner flap devoid of adhesive to provide an inlet slot for said inner envelope.

12. A duplex envelope according to claim 7 wherein said top page includes a perforated fourth separation line across the width thereof, and said third and fourth perforation lines are located equidistantly from said first perforation line.

13. A duplex envelope according to claim 12 wherein said fourth perforation line is spaced from the top edge of said top page to define a band extending across the width thereof matching in configuration said outer flap for being permanently bonded thereto when laminated to said outer adhesive strip.

14. A duplex envelope according to claim 13 wherein said top page further includes a perforated fifth separation line extending vertically between said first and fourth separation lines, and spaced laterally from a side edge of said top page to define an insert sized to fit inside said inner envelope.

15. A duplex envelope comprising:

a face sheet divided into a top page, a bottom page, an inner flap, and an outer flap by corresponding first, second, and third perforation lines;

a liner divided into a pocket permanently bonded to said bottom page to define an inner envelope therewith, an inner tab removably bonded atop said inner flap adjoining said pocket, and an outer tab removably bonded atop said outer flap adjoining said inner tab;

said top page being foldable atop said liner pocket for defining an outer envelope therewith; and wherein said top page further includes a perforated fourth separation line across the width thereof, and said third and fourth perforation lines are located equidistantly from said first perforation line.

16. A duplex envelope according to claim 15 further comprising:

an adhesive border permanently bonding the perimeter of said pocket to said bottom page;

an adhesive inner strip disposed along said inner flap and removably bonded to said inner tab;

an adhesive outer strip disposed along said outer flap and removably bonded to said outer tab; and wherein said fourth perforation line is spaced from the top edge of said top page to define a band extending across the width thereof matching in configuration said outer flap for being permanently bonded thereto when laminated to said outer adhesive strip.

17. A duplex envelope according to claim 16 wherein said liner pocket, inner tab, and outer tab are separated by corresponding diecuts.

18. A duplex envelope according to claim 17 wherein:

said liner inner and outer tabs include a silicone release coating for being removably bonded to said inner and outer adhesive strips; and said liner pocket is devoid of said release coating along said adhesive border for forming a permanent bond with said bottom page.

19. A duplex envelope according to claim 18 wherein said liner pocket, inner tab, and outer tab extend in parallel across the width of said bottom page.

20. A duplex envelope according to claim 19 wherein said adhesive border extends continuously along three edges of said bottom page, leaving a remaining fourth edge of said bottom page along said inner flap devoid of adhesive to provide an inlet slot for said inner envelope.

* * * * *

UNITED STATES PATENT AND TRADEMARK OFFICE

CERTIFICATE OF CORRECTION

PATENT NO. : 6,612,484 B2 
DATED : September 2, 2003
INVENTOR(S) : Rawlings, T.W. and Halbrook, W.B.

It is certified that error appears in the above-identified patent and that said Letters Patent is hereby corrected as shown below:

Column 6,
Line 57, after “separation” delete “linc” and insert -- line --

Signed and Sealed this

Twenty-eighth Day of October, 2003

JAMES E. ROGAN
*Director of the United States Patent and Trademark Office*